United States Patent [19]

Sanville

[11] 4,379,330

[45] Apr. 5, 1983

[54] RAILROAD CAR WHEEL DETECTOR

[75] Inventor: W. Woodward Sanville, Brentwood, N.Y.

[73] Assignee: Servo Corporation of America, Hicksville, N.Y.

[21] Appl. No.: 224,912

[22] Filed: Jan. 14, 1981

[51] Int. Cl.[3] ..... B61L 13/04

[52] U.S. Cl. ..... 364/424; 246/249

[58] Field of Search ..... 364/424, 426, 565, 572; 328/165; 324/166, 167, 239; 246/194, 249; 235/92 MT, 92 CA

[56] References Cited

U.S. PATENT DOCUMENTS

| | | | |
|---|---|---|---|
| 3,151,827 | 10/1964 | Gallagher et al. | 324/239 |
| 3,721,821 | 3/1973 | Blanyer | 246/249 |
| 3,964,703 | 6/1976 | Wilkas et al. | 246/249 |
| 4,040,001 | 8/1977 | Vivet et al. | 328/165 |
| 4,155,526 | 5/1979 | Noble | 246/249 |
| 4,169,232 | 9/1979 | Henrich | 328/165 |
| 4,274,611 | 6/1981 | Salmon | 246/249 |

*Primary Examiner*—Gary Chin

*Attorney, Agent, or Firm*—Kane, Dalsimer, Kane, Sullivan and Kurucz

[57] ABSTRACT

A method is provided for determining whether an output signal from a magnetic railway wheel detector is produced by the actual passage of a wheel over the transducer. The output signal is compared with an amplitude threshold value and the time period between the zero crossing point and the time at which the signal attains amplitude threshold is compared with a time threshold level. The thresholds are set as a function of the speed of the train. Unless the thresholds are exceeded the output signal is disregarded.

5 Claims, 2 Drawing Figures

Same wheel travelling at two different speeds, b > a, over same transducer

Different wheels travelling at same speed over same wheel transducer

RAILROAD CAR WHEEL DETECTOR

BACKGROUND OF THE INVENTION

The present invention relates to railroad equipment and in particular to improvements in the circuitry for detecting the presence of a railroad car wheel at a particular location.

There are presently available railroad wheel detectors which serve to detect the presence of a wheel at a particular location. Such detectors are used, for example, to trigger gate crossing controls, track shunts, car axle counters and various transducers such as hot box detectors, speed and acceleration measurement devices and for other similar applications.

Magnetic wheel detectors are disclosed, for example, in U.S. Pat. No. 3,151,827 and are available commercially from the Servo Corporation of America of Hicksville, New York sold under the trademarks SERVOPOLE and SERVOTRIP.

The detectors rely on variable reluctance magnetic sensing transducers which generate a voltage signal in response to a change in flux resulting from the coming and going of a railroad car wheel toward and away from the detector. Thus, the detector is usually mounted to a rail of the track. As a wheel approaches the detector, the steel wheel reacts with a magnetic circuit producing a flux change which in turn results in a generally sinusoidal output signal. The cross over point of the output signal occurs when the wheel is dead center over the sensing element.

While detectors of the type described above have operated successfully for many years, the detectors are susceptible to noise which could result in false triggering. As a result, such detectors were provided with an amplitude threshold circuit to cut out low level signals. Unfortunately, since the signal level varies with train speed, setting a threshold too high could result in missed signals from slow moving trains.

As mentioned, such detectors are rail mounted and as a result, may be subjected to extreme vibration, particularly from high speed trains. Such vibrations, by jolting the equipment, can result in short duration pulses. In order to eliminate such pulses from possible consideration as wheel signals, a time threshold is provided so that unless a given pulse exceeds a minimum time duration, it is ignored as comprising a possible wheel signal. Unfortunately, at very high speeds (in excess of 85 miles per hour) a true wheel pulse is relatively short and thus the possibility exists that such pulses may be missed for failing to exceed the time threshold set to avoid spurious signals.

From the above, it should be apparent that available wheel detectors have difficulty in detecting wheel pulses for trains moving at extremely slow (less than 5 mph) or fast (in excess of 85 mph) speeds. The former because the resultant wheel pulses may fail to exceed the amplitude threshold set to avoid noise and the latter because the resultant wheel pulses may fail to exceed the time threshold set to avoid spurious vibration signals.

Heretofore, several observations have been made regarding the output voltage signals produced by magnetic wheel detectors:

1. For a given train wheel, the zero crossing (in space), related to the center of the detector, of the output voltage signal remains substantially constant regardless of the train speed;
2. For a given train wheel, the maximum amplitude of the output voltage signal varies directly with the train speed;
3. As between different wheels, even on the same train, the amplitude and time duration of the output voltage signal can vary significantly even if travelling at the same speed;
4. For a given speed, even as between different wheels, the distance from the output voltage signal peak to the zero crossing is substantially the same.

The above is depicted in FIGS. 1*a* and 1*b*.

In view of the above, it is the principal object of the present invention to provide an improved railroad car wheel detector particularly capable to identify, with a high degree of reliability, exceedingly fast or slow moving railroad car wheels;

A further object is to provide such a detector which utilizes conventional transducers to detect and identify passing railway car wheels;

A still further object is to provide such a detector which may be implemented at reasonable cost and which may readily be implemented into existing systems.

SUMMARY OF THE INVENTION

The above and other beneficial objects and advantages are attained in accordance with the present invention by providing an improved system for determining whether the output signal of a magnetic railway car wheel detector was triggered by the passage of an actual wheel or comprises a spurious signal. To this end, the voltage value of the output signal is compared with a threshold value. Unless the voltage threshold is exceeded the output signal is treated as noise. The voltage threshold value is set as a function of the speed of a passing train. The duration of the time from the signal equaling the amplitude threshold to a zero crossing point is also determined and unless that time exceeds a time threshold value the signal is treated as noise. The time threshold is also set as a function of the speed of the train. The speed of the train is constantly monitored and the voltage threshold level and time threshold are updated to reflect changes in speed.

DETAILED DESCRIPTION OF THE PREFERRED EMBODIMENT

Figure 2:
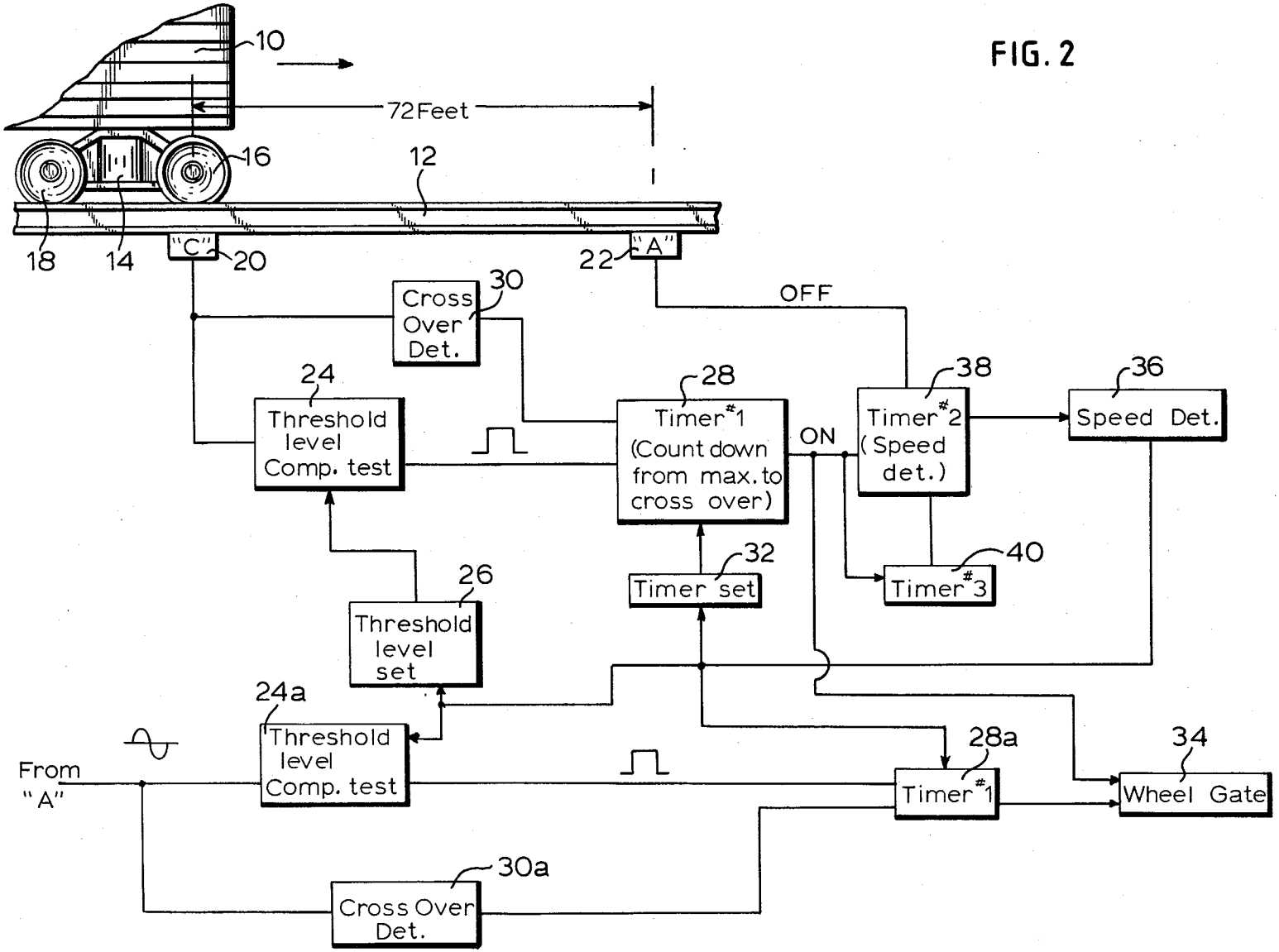
FIG. 2 is a block diagram of the car wheel detector circuit of the present invention.

Reference is now made to the drawings and particularly to FIG. 2 wherein a railway car 10 is shown on a length of track 12 proceeding in the direction of the arrow. The car 10 is supported on a truck 14 carrying a pair of axles to which wheels 16 and 18 are mounted. The distance between the axles for wheels 16 and 18 is approximately 9 feet for locomotives in service in the United States.

Figure 1A:
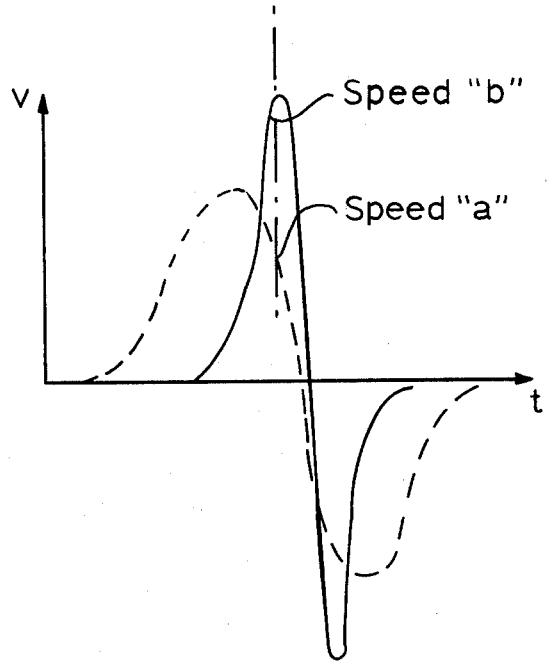
FIG. 1*a* is an idealized wave form output of a magnetic wheel detector depicting the signals produced by the same wheel passing a detector at two different speeds.
Figure 1B:
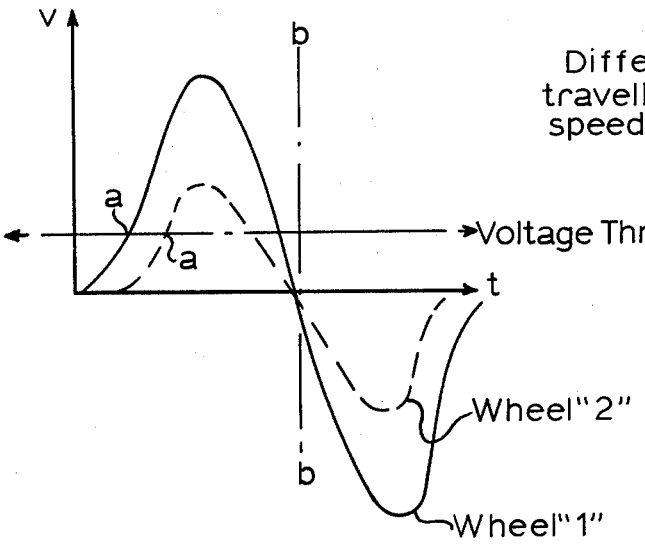
FIG. 1*b* is an idealized wave form similar to FIG. 1*a* depicting the signals generated by two different wheels passing a detector at the same speed.

A magnetic wheel transducer 20 is mounted to a rail of track 12. The transducer is of the variable reluctance type. It includes coils which detect changes in a magnetic field caused by the passage of a railway car wheel. The changes in the magnetic field are detected in the form of a voltage across the coil which assumes the generally sinusoidal shape of the wave forms of FIGS. 1*a* and 1*b*. The zero crossing point represents the passage of the wheel directly over the detector transducer.

The wheel detector 20 is generally used in conjunction with one or more similar detectors 22 mounted along the track with the assemblage of detectors used, for example to gate an infra-red heat detector, crossing gate, crossing signal or the like.

In accordance with the present invention the output of detector 20 is fed as one input to a comparator 24, the other input to the comparator 24 comprises the output of a threshold level set circuit 26. The setting of the threshold level will be discussed forthwith. Unless the value of the output of the detector exceeds the threshold level the signal from the wheel detector is treated as noise and disregarded. If the threshold set level is exceeded the coincidence is used to start count down timer 28 which runs until zero crossing occurs (as determined by a zero crossing detector circuit 30) or until the counter runs out from the time set by a timer set circuit 32. In other words, the time determines the time duration between "a" and "b" of FIG. 1*b*. If the zero cross occurs before counter 28 has run down, the time threshold value determined by timer set circuit 32 will not have been exceeded and the signal is treated as noise. If zero cross occurs after counter 28 has counted down, the output of the detector is fed to a wheel gate and treated as an actual wheel present at detector 20.

The voltage threshold level set circuit 26 and timer set circuit 32 in turn are controlled by a speed determining circuit 36. When the speed of train 10 is determined the voltage threshold level and minimum cross over time are set to values for a train moving at that speed. As previously stated, the voltage threshold value is increased for faster trains and decreased for slower trains while the time threshold value is set higher for slow trains and lower for fast trains.

In order to determine the speed of train 10, the output of second transducer 22 is used to turn off a counter 38 which is turned on by the output of timer 28. By knowing the distance between transducers 20 and 22 and the time required for the wheel to travel from transducer 20 to transducer 22 the speed of the wheel can readily be calculated.

The above may readily be used for all wheels after the first wheel of the train (since the first wheel can be used to set the speed for the second wheel, the second wheel for the third wheel and so on). For the first wheel 16 a special accommodation must be made. To this end, the present invention makes use of the facts that there are no single wheel trucks and that the distance between the axles of the adjacent wheels 16 and 18 on the first truck of a locomotive is approximately 9 feet.

A third timer 40 is provided which is turned on by the output of timer 28 and turned off by the next pulse from timer 28 (i.e., timer 40 is turned on by the passage of wheel 16 and off by the passage of wheel 18). Timer 40 is programmed so that if it is turned off before the passage of 30 ms it stops counter 28 and resets it. 30 ms corresponds to the time required between pulses from wheels 16 and 18 for a train travelling at 200 mph. If counter 40 is turned off in less than 30 ms the assumption is made that there was no wheel present to start counter 28 (and that noise started the counter) but that a wheel was present to stop the counter. Timer 40 is also programmed so that if the off signal does not appear in approximately 3 second counter 28 is stopped. Three seconds corresponds approximately to the time required between pulses for a train travelling at 2 mph.

Wheel detector 22 (and any other wheel detectors) is provided with its voltage versus threshold comparator 24*a*, cross over detector 30*a* and timer 28*a* which operate in the manner described above.

Thus, in accordance with the present invention the threshold values for a wheel detector may be adjusted precisely to more accurately eliminate noise and spurious signals.

Having thus described the invention, what is claimed is:

1. The method for determining whether an output signal of a magnetic wheel detector mounted along a length of railroad track is being triggered by an actual train wheel moving along a length of track or a spurious signal comprising the steps of:

(a) detecting the value of a suspected output signal and comparing it with an amplitude threshold level;

(b) determining the time duration of said suspected signal from the time at which said suspected signal exceeds said amplitude threshold value to a zero crossing of said suspected signal;

(c) determining the speed of said train;

(d) setting said amplitude threshold level and said time threshold value as functions of the speed of said train and, (e) determining that said suspected signal was triggered by an actual train wheel only if the value of said suspected signal exceeds said amplitude threshold value and the time duration of said suspected signal exceeds said time threshold.

2. The invention in accordance with claim 1 comprising the further step of:

(a) constantly monitoring the speed of said train and updating the threshold level and time threshold value as said speed varies.

3. A system for use in determining whether an output signal of a magnetic wheel detector mounted along a length of railroad track is being triggered by an actual train wheel moving along the length of track or a spurious signal comprising:

(a) a magnetic wheel detector mounted along the length of railroad track and adapted to generate an output signal upon the passage of a train wheel;

(b) an amplitude comparator connected to said wheel detector and to an amplitude threshold setting circuit for comparing the amplitude of said wheel detector output signal with the amplitude threshold of said circuit and for determining when said output signal amplitude exceeds said amplitude threshold;

(c) an amplitude threshold setting circuit connected to said amplitude comparator;

(d) a timer connected to the output of said amplitude comparator for determining the time duration from the time at which said output signal amplitude exceeds said amplitude threshold to a zero crossing of said output signal;

(e) a time comparator connected to said timer and to a time threshold value setting circuit for comparing (1) the time duration from the time at which said output signal amplitude exceeds said output signal amplitude threshold to a zero crossing of said output signal to (2) a time threshold value;

(f) a time threshold setting circuit connected to said time comparator;

(g) means for determining the speed of said train; said means being connected in controlling relationship to said amplitude threshold setting circuit and said time threshold setting circuit whereby said amplitude threshold and time threshold are set as functions of the train speed, and, (h) means connected to said amplitude and time comparators for determining if said amplitude and time thresholds have been exceeded whereby said output signal is presumed to have been triggered by a train wheel passing said detector.

4. The system in accordance with claim 3 wherein said speed determining means includes a second wheel detector mounted a fixed distance downstream of said wheel detector and second timer means triggered on by said wheel detector and off by said second wheel detector whereby the time required by a wheel to traverse the fixed distance can be determined to calculate the speed of said train.

5. The system in accordance with claim 4 further comprising a third timer reset by said timer means and adapted to stop said second timer if said third timer is reset in less than a first predetermined time or more than a second predetermined time.

* * * * *